US011021782B2

(12) United States Patent
Li et al.

(10) Patent No.: US 11,021,782 B2
(45) Date of Patent: Jun. 1, 2021

(54) STEEL COMPOSITIONS AND SOLUTION NITRIDING OF STAINLESS STEEL THEREOF

(71) Applicant: Apple Inc., Cupertino, CA (US)

(72) Inventors: Hoishun Li, San Jose, CA (US); Ethan E. Currens, San Francisco, CA (US); Weiming Huang, State College, PA (US); James A. Wright, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/926,897

(22) Filed: Mar. 20, 2018

(65) Prior Publication Data

US 2018/0265958 A1 Sep. 20, 2018

Related U.S. Application Data

(60) Provisional application No. 62/473,575, filed on Mar. 20, 2017.

(51) Int. Cl.

| | |
|---|---|
| ***C23C 8/26*** | (2006.01) |
| ***C23C 8/80*** | (2006.01) |
| ***C22C 38/44*** | (2006.01) |
| ***C22C 38/42*** | (2006.01) |
| ***C22C 38/50*** | (2006.01) |
| ***C22C 38/00*** | (2006.01) |
| ***C22C 38/48*** | (2006.01) |
| ***C22C 38/06*** | (2006.01) |
| ***C22C 38/04*** | (2006.01) |
| ***C22C 38/02*** | (2006.01) |
| ***C22C 38/46*** | (2006.01) |
| ***C21D 1/74*** | (2006.01) |
| ***C21D 6/00*** | (2006.01) |
| ***C23C 8/02*** | (2006.01) |
| *C21D 1/06* | (2006.01) |
| *C21D 8/02* | (2006.01) |

(52) U.S. Cl.

CPC ..... *C23C 8/26* (2013.01); *C21D 1/74* (2013.01); *C21D 6/004* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C23C 8/02* (2013.01); *C23C 8/80* (2013.01); *C21D 1/06* (2013.01); *C21D 8/0257* (2013.01); *C21D 2211/001* (2013.01); *C21D 2211/005* (2013.01); *C21D 2261/00* (2013.01)

(58) Field of Classification Search

CPC ..... C22C 38/001; C22C 38/18; C22C 38/42; C22C 38/44; C22C 8/80; C22C 38/50; C22C 38/06; C22C 38/04; C22C 38/48; C22C 38/46; C23C 8/26; C23C 8/80; C21D 1/06

See application file for complete search history.

(56) References Cited

U.S. PATENT DOCUMENTS

| | | | | |
|---|---|---|---|---|
| 3,904,401 | A * | 9/1975 | Mertz | C22C 38/001 420/42 |
| 8,152,937 | B2 * | 4/2012 | Ishii | C21D 8/0205 148/325 |
| 2006/0034724 | A1 * | 2/2006 | Hamano | C21D 6/002 420/39 |
| 2006/0037669 | A1 | 2/2006 | Kuroda et al. | |
| 2007/0186999 | A1 | 8/2007 | Kuroda et al. | |
| 2010/0139818 | A1 | 6/2010 | Ishii et al. | |
| 2012/0201712 | A1 | 8/2012 | Oshchepkov | |

FOREIGN PATENT DOCUMENTS

| | | |
|---|---|---|
| DE | 4411296 | 7/1995 |
| EP | 2037337 | 3/2009 |
| JP | 2001-140041 | 5/2001 |
| JP | 2008-303413 | 12/2008 |
| JP | 2011-214058 | 10/2011 |
| JP | 5291479 | 9/2013 |

OTHER PUBLICATIONS

Headly TJ, Brooks JA. A new bcc-fcc orientation relationship observed between ferrite and austenite in solidification structures of steels. Metall. Mater. Trans. A, 2002; 33(1): 5-15.*

English Machine Translation of the Detailed Description of Haruna et al. (JP 2008-303413) (Dec. 18, 2018).*

Nakada et al., "Grain refinement of nickel-free nigh nitrogen austenitic stainless steel by reversion of eutectoid structure," *Scripta Materialia*, 57 (2007), pp. 153-156.

"Chemical composition of stainless steel," Yamashin Steel Co., Inc., http://www.yamco-yamashin.com/en/products/guide_stainless_steel.html, accessed Apr. 26, 2019.

* cited by examiner

*Primary Examiner* — Jessee R Roe

(74) *Attorney, Agent, or Firm* — BakerHostetler

(57) ABSTRACT

The disclosure provides methods of making iron-based alloys, as well as resulting alloys. An iron-based alloy containing a small amount of nickel (e.g., 0.5 to 2.0 wt %) is annealed and machined. The alloy is sufficiently ductile to reduce the likelihood of cracking, while not sufficiently high to result in a hardened alloy. After the alloy is shaped, the alloy is hardened by nitriding.

14 Claims, 9 Drawing Sheets

STEEL COMPOSITIONS AND SOLUTION NITRIDING OF STAINLESS STEEL THEREOF

CROSS-REFERENCE TO RELATED PATENT APPLICATION

This patent application claims the benefit under 35 U.S.C. § 119(e) of U.S. Patent Application No. 62/473,575, entitled "STEEL COMPOSITIONS AND SOLUTION NITRIDING OF STAINLESS STEEL THEREOF," filed on Mar. 20, 2017, which is incorporated herein by reference in its entirety.

FIELD

The disclosure is directed to alloy compositions and methods including solution nitriding of stainless steel.

BACKGROUND

Stainless steel is widely used as a structural component due to its deformability and corrosion resistance. Stainless steel can be solid solution strengthened by nitrogen. For example, Ni-free high nitrogen austenitic stainless steel has been prepared by solution nitriding by Nakada et al. (Scripta Materialia 57(2007) 153-156, "Grain refinement of nickel-free high nitrogen austenitic stainless steel by reversion of eutectoid structure." A stable austenitic structure is formed by solution nitriding. However, the austenitic Fe-25Cr-1N mass % alloy is brittle, and cracks easily.

There remains a need to develop techniques to develop alloy compositions and fabrication methods for improving properties of stainless steel.

BRIEF SUMMARY

In one aspect, the disclosure is directed to a method of making an iron-based alloy. The method includes first annealing an iron-based alloy comprising 21 to 25.5 wt % Cr, 0.5 to 2.0 wt % Ni, and less than or equal to 0.5 wt % Mo to form an annealed alloy. At these low Ni contents, the alloy will solidify and remain in the BCC phase during processing. At this stage, the annealed alloy has a body-centered cubic (BCC) crystal structure, and remains magnetic. One challenge of ferritic alloys is the low ductility at high strain rates and/or low temperatures. The low ductility of these alloys is further reduced due to the precipitation of embrittling sigma phases. Increasing Ni content increases the matrix ductility of ferritic alloys, thus offering better processing capability.

The annealed alloy can be machined and shaped. The machined alloy can then be hardened in a furnace filled with a nitrogen gas at a first elevated temperature of at least 1000° C. for a period of time. During "nitriding," the alloy absorbs nitrogen, and undergoes a BCC to face-centered cubic (FCC) phase transition. Due to the high nitrogen content of the FCC alloy, the material hardness is increased. The alloy having a FCC crystalline form is non-magnetic.

By annealing and machining the alloy prior to nitride hardening, the alloy can be shaped using substantially less energy, and substantially reduce any required pre-shaping (e.g., pre-forging) used for already hardened alloys. The fully machined alloy is hardened and rendered non-magnetic simultaneously, reducing the number of hardening steps and associated cost. Reducing the amount of nickel compared to traditional 300-series FCC alloys substantially also reduces alloy cost.

In some variations, the hardened, machined alloy can be quenched to a eutectoid temperature for a second period of time to form a quenched alloy. The quenched alloy can be recrystallized at a second elevated temperature for a third period of time. The recrystallized alloy can be further quenched to room temperature to form a hardened machined alloy.

In some additional variations, the method provides that the alloy undergoes a linear contraction of less than or equal to 0.3%. The contraction is the sum of two counterposing phenomenon: the phase transformation from BCC to FCC results in a contraction, while the absorption of nitrogen into the FCC interstitial lattice sites expands the material. Again, the resulting alloy can have a FCC structure and be non-magnetic.

In another aspect, the disclosure is directed to an alloy having from 21 to 25.5 wt % Cr, from 0.5 to 2.5 wt % Ni, and from 0 to 0.5 wt % Mo. In additional variations, the alloy includes up to 0.7 wt % Mn and up to 0.6 wt % Si to facilitate conventional melt practices. In further variations, the alloy has less than or equal to 0.5 wt % Cu. In further variations, the alloy has less than or equal to 0.04 wt % P, less than or equal to 0.01 wt % S, less than or equal to 0.010 wt % Al, less than or equal to 0.15 wt % V, less than or equal to 0.0050 wt % Ca, less than or equal to 0.01 wt % O, less than or equal to 0.1 wt % Ti, less than or equal to 0.5 wt % Nb, and trace elements each in a quantity less than or equal to 0.1 wt %, where Fe is the balance. In some variations, the alloy has 0.8 wt %-1.5 wt % nitrogen in a FCC phase. In some variations, the alloy has less than or equal to 0.1 wt % N in a BCC phase.

In some variations, the alloy can have a hardness of at least 300 Hv. In additional variations, the hardness varies by less than or equal to 10 Hv across the transformed region. In additional variations, the alloy has a pitting potential of at least 1000 mVsce. In still further variations, the alloy can have a passive current density less than or equal to $2.0\times10^{-4}$ mA/cm$^2$ after being polished. In some additional variations, the alloy can have a passive current density less than or equal to $5.0\times10^{-3}$ mA/cm$^2$.

In some variations, the hardened, machined alloy can have a recrystallized grain size between 20 μm and 100 μm. The standard deviation of the grain size can be between 5 μm and 30 μm.

Additional embodiments and features are set forth in part in the description that follows, and will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

Conventional processes of forming steel involve machining after steel hardening. Such conventional processes can add substantial costs to steel manufacture, decrease tool life, and increase the carbon footprint of manufacture.

The disclosure provides fabrication methods and manufacturing processes, along with alloys, that have advantages over conventional processes of steel manufacture. The manufacturing process includes Computer Numeric Control (CNC) machining annealed alloys with sufficiently low nickel to provide ductility. The pre-hardened alloys allow forming steps to be accomplished with substantially less machining than for a hardened alloy. The alloys are then hardened by nitriding, which also causes the alloy to undergo a phase change from a BCC crystal structure (magnetic) to a FCC crystal structure (non-magnetic). The reduced amount of Ni allows the alloy to be sufficiently ductile to reduce cracking.

Shaping the alloy in the softened state allows for extended tool life, and also can reduce the cost and machining time associated with CNC. When compared to machining the hardened alloys in the conventional manufacturing process, the manufacturing process can provide improvement of about 30% in the tool life and can reduce the production cost and/or time by processing an alloy that is not yet hardened, rather than processing the hardened alloy. Reducing the amount of nickel substantially also reduces alloy cost.

The disclosure provides iron-based alloys including chromium (Cr) ranging from 21 wt % to 25.5 wt %, low nickel (Ni) content ranging from 0.5 wt % to 2.0 wt %, and less than or equal to 0.5 wt % molybdenum (Mo). The Ni and Mo contents are much lower than commercial stainless steel alloys, such as stainless steel 316.

Figure 1:
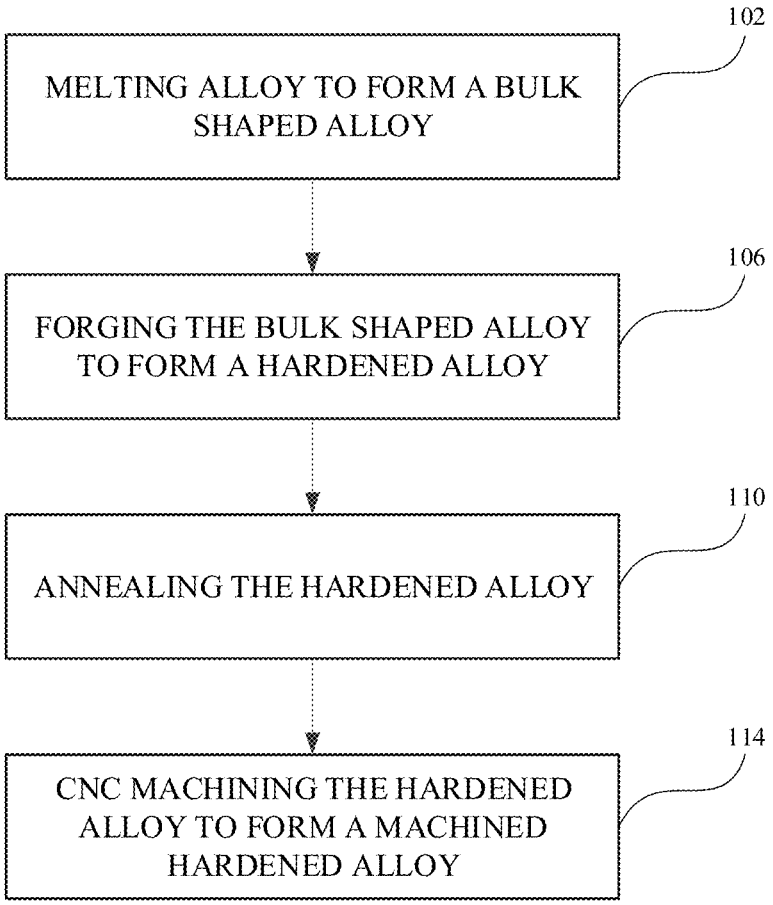
FIG. 1 is a flow chart illustrating a conventional manufacturing process for producing a machined hardened alloy in an embodiment of the disclosure.

FIG. 1 is a flow chart illustrating a conventional manufacturing process for producing a machined hardened alloy in an embodiment of the disclosure. In the conventional manufacturing process, an alloy, such as stainless steel 316, may be melted to form a bulk shaped alloy at operation 102. The stainless steel 316 is non-magnetic and has a faced centered crystal (FCC) crystal structure. The bulk shaped alloy may then be forged to form a forged alloy that achieves both shape and hardness at operation 106.

The forged alloy may then be annealed to form an annealed alloy at operation 110. Annealing is a heat treatment that alters the physical and sometimes chemical properties of an alloy to increase its ductility and reduce its hardness, making the alloy more workable. Annealing involves heating an alloy to above its recrystallization temperature, maintaining a suitable temperature, and then cooling. Atoms migrate in the crystal lattice and the number of dislocations decreases. The annealed alloy may then be machined by Computer Numeric Control (CNC) machining at operation 114.

Figure 2:
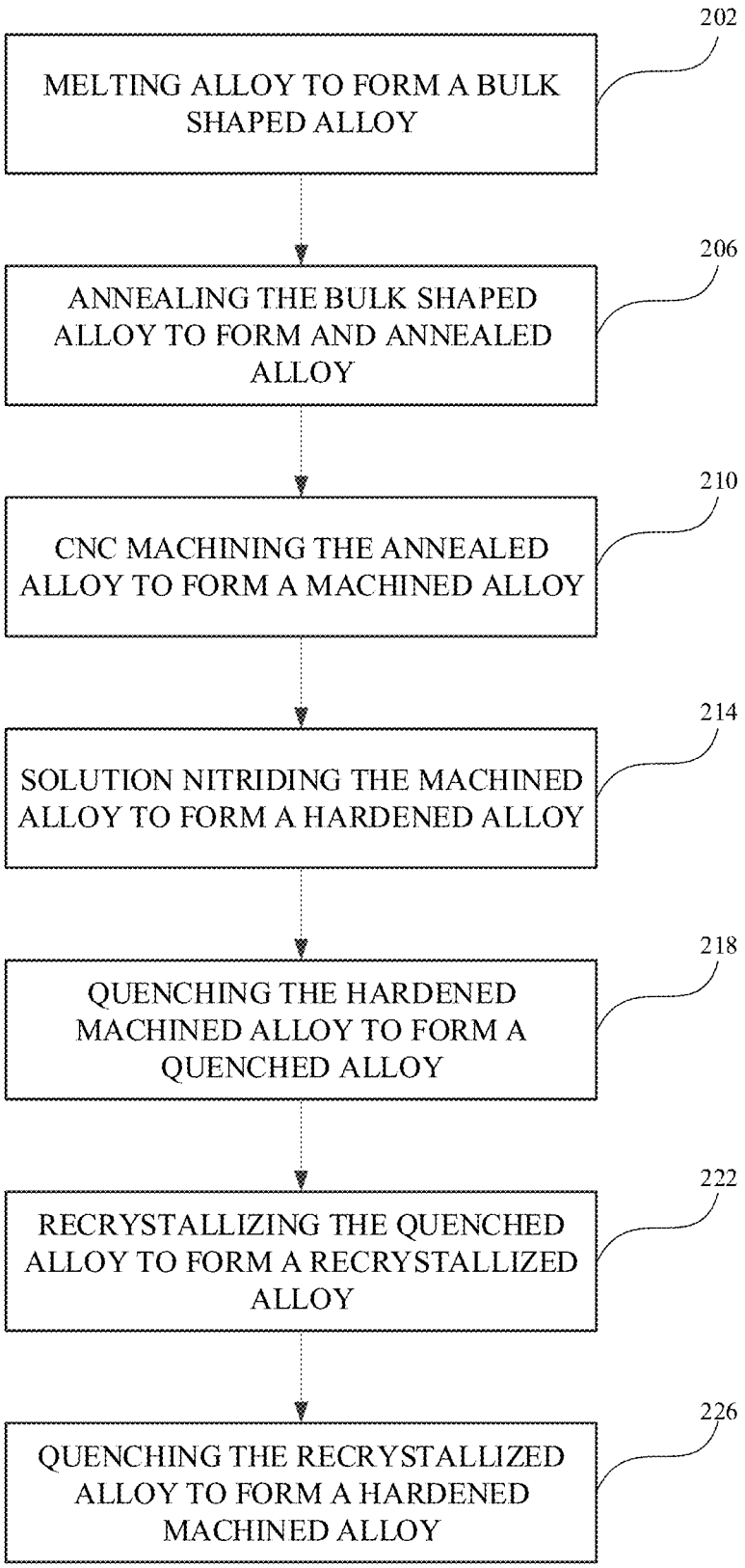
FIG. 2 is a flow chart illustrating a manufacturing process including solution nitriding for producing a hardened machined alloy in an embodiment of the disclosure.

FIG. 2 is a flow chart illustrating a manufacturing process including solution nitriding for producing a hardened machined alloy, in an embodiment of the disclosure. An alloy is melted to form a bulk shaped alloy at operation 202. In some embodiments, the alloy may be melted using argon oxygen decarburization (AOD) melting, followed by continuous casting to form a bulk shaped alloy. The alloy may also be melted by arc or AE.

The bulk shaped alloy may then be annealed to form an annealed alloy at operation 206. The annealed alloy is softer than the hardened alloy, and is thus easier to be machined. The annealed alloy can be machined by CNC to form a machined alloy at operation 210. The machined alloy is hardened by nitriding. As a result of using the iron-based alloy with a low Ni content (e.g., 1.0-2.0 wt %), the hardened machined alloy is more ductile and resistant to cracking.

In some embodiments, the alloy may be iron based including chromium (Cr) ranging from 21 wt % to 25.5 wt %, nickel (Ni) content ranging from 0.5 wt % to 2.0 wt %, and less than or equal to 0.5 wt % molybdenum (Mo). The iron-based alloy before solution nitriding, referred to pre-nitriding, is magnetic and has a body-centered cubic (BCC) crystal structure.

The alloy can be processed according to any method known in the art. In some embodiments, the alloy may be molded into a bulk shaped alloy, for example, by metal injection molding (MIM). Alternatively, in some embodiments, the alloy may be forged into a bulk shaped alloy. Fewer forging steps than are used in conventional process are used.

The CNC cycle time may be generally about 3000 seconds for the stainless steel 316, while the CNC cycle time may be reduced to 2250 seconds for the iron-based alloy. As such, the cycle time for the iron-based alloy is 25% less. The CNC average power may be about 4 kW. The energy consumption for the CNC is a product of the power by time. Due to reduced cycle time for the iron-based alloy, the energy consumption by CNC may be reduced for about 25% for the iron-based alloy.

Referring again to FIG. 2, the machined alloy can then be solution nitrided to form a hardened machined alloy at operation 214. The hardness of the alloy in the manufacturing process shown in FIG. 2 is independent of shaping, unlike the conventional manufacturing process shown FIG. 1 where forging must achieve both shape and hardness simultaneously.

In some embodiments, solution nitriding may be performed at an elevated temperature for a period of time with nitrogen gas. For example, solution nitriding may be performed in a furnace filled with nitrogen gas. The furnace may be heated to at least 1000° C., alternatively to at least 1100° C., alternatively to at least 1200° C. In some embodiments, the furnace can be heated to 1180° C. for 12 hours with a gas pressure, e.g. 0.95 bar. The nitrogen can penetrate the alloy to a depth of up to 1.5 mm. The nitrogen diffusion distance, thus the bcc to fcc transformation depth, d, is proportional to the square root of the nitriding time, t, times the nitrogen diffusivity in the alloy, D, according to Equation (1):

$$d \propto \sqrt{Dt} \qquad \text{Equation (1)}$$

In various embodiments, the nitrogen gas pressure may vary from 1 bar to 3.5 bars. The gas pressure and furnace temperature, as well as nitriding time, may vary to affect the diffusion depth. It will be appreciated by those skilled in the art that the thickest dimension may vary with the parameters for solution nitriding, such as gas pressure, nirtiding time, temperature, among others.

In alternative embodiments, a two-step nitriding process may be used. The first step nitriding process may be at a first gas pressure. The second step nitriding process may be at a second gas pressure lower than the first pressure. The two-step nitriding process may improve the hardness more than the single step nitriding process. In some embodiments, the two-step nitriding process may be performed at the same elevated temperature. In other embodiments, the two-step nitriding process may be performed at different elevated temperatures. The first elevated temperature for the first nitriding process may be lower or higher than the second elevated temperature for the second nitriding process.

Referring again to FIG. 2, the manufacturing process can also include a step of quenching the hardened machined alloy at an eutectoid temperature to form a quenched alloy at operation 218.

When the post-nitriding alloy is quenched to an eutectoid temperature for a period of time, the post-nitriding alloy has a BCC crystalline form with chromium nitride ($Cr_2N$) precipitates. The alloy may be quenched for a temperature and period of time known in the art. For example, in some embodiments, the alloy may be quenched to 650° C. for an hour. By way of example and not limitation, a simulation was formed to predict that the BCC—$Cr_2N$ grain refinement may occur between 580° C. and 720° C.

Alloys

The disclosure provides iron-based alloys including chromium (Cr) ranging from 21 wt % to 25.5 wt %, low nickel (Ni) content ranging from 0.5 wt % to 2.0 wt %, and less than or equal to 0.5 wt % molybdenum (Mo). The Ni and Mo contents are much lower than commercial stainless steel alloys, such as stainless steel 316. Various other elements can be included in the alloys, as described herein.

Chromium

The iron-based alloy can include Cr. Increasing Cr resists corrosion in the alloy.

In some embodiments, the iron-based alloys include Cr from 21 to 25.5 wt %. In some embodiments, the alloys include Cr less than 25.5 wt %. In some embodiments, the alloys include Cr less than 25.0 wt %. In some embodiments, the alloys include Cr less than 24.5 wt %. In some embodiments, the alloys include Cr less than 24.0 wt %. In some embodiments, the alloys include Cr less than 23.5 wt %. In some embodiments, the alloys include Cr less than 23.0 wt %. In some embodiments, the alloys include Cr less than 22.5 wt %. In some embodiments, the alloys include Cr less than 22.0 wt %. In some embodiments, the alloys include Cr less than 21.5 wt %.

In some embodiments, the alloys include Cr greater than 21 wt %. In some embodiments, the alloys include Cr greater than 21.5 wt %. In some embodiments, the alloys include Cr greater than 22.0 wt %. In some embodiments, the alloys include Cr greater than 22.5 wt %. In some embodiments, the alloys include Cr greater than 23.0 wt %. In some embodiments, the alloys include Cr greater than 23.5 wt %. In some embodiments, the alloys include Cr greater than 24.0 wt %. In some embodiments, the alloys include Cr greater than 24.5 wt %. In some embodiments, the alloys include Cr greater than 25.0 wt %.

Nickel

As described herein, the alloys include a sufficient amount of nickel for the alloy to be ductile, but not so much nickel that the alloy is BCC prior to nitriding. Transformation to FCC and hardening is instead accomplished by nitriding the shaped alloy. The reduction in nickel allows the alloy to be shaped in a pre-hardened state, with sufficient ductility to reduce the likelihood of cracking.

In some embodiments, the iron-based alloys include Ni from 0.5 to 2.0 wt %. In some embodiments, the alloys include Ni equal to or less than 2.0 wt %. In some embodiments, the alloys include Ni equal to or less than 1.9 wt %. In some embodiments, the alloys include Ni equal to or less than 1.8 wt %. In some embodiments, the alloys include Ni equal to or less than 1.7 wt %. In some embodiments, the alloys include Ni equal to or less than 1.6 wt %. In some embodiments, the alloys include Ni equal to or less than 1.5 wt %. In some embodiments, the alloys include Ni equal to or less than 1.4 wt %. In some embodiments, the alloys include Ni equal to or less than 1.3 wt. In some embodiments, the alloys include Ni equal to or less than 1.2 wt %. In some embodiments, the alloys include Ni equal to or less than 1.1 wt %. In some embodiments, the alloys include Ni equal to or less than 1.0 wt %. In some embodiments, the alloys include Ni equal to or less than 0.9 wt. In some embodiments, the alloys include Ni equal to or less than 0.8 wt %. In some embodiments, the alloys include Ni equal to or less than 0.7 wt %. In some embodiments, the alloys include Ni equal to or less than 0.6 wt %.

In some embodiments, the alloys include Ni equal to or greater than 0.5 wt %. In some embodiments, the alloys include Ni equal to or greater than 0.6 wt %. In some embodiments, the alloys include Ni equal to or greater than 0.7 wt %. In some embodiments, the alloys include Ni equal to or greater than 0.8 wt %. In some embodiments, the alloys include Ni equal to or greater than 0.9 wt %. In some embodiments, the alloys include Ni equal to or greater than 1.0 wt %. In some embodiments, the alloys include Ni equal to or greater than 1.1 wt %. In some embodiments, the alloys include Ni equal to or greater than 1.2 wt %. In some embodiments, the alloys include Ni equal to or greater than 1.3 wt %. In some embodiments, the alloys include Ni equal to or greater than 1.4 wt %. In some embodiments, the alloys include Ni equal to or greater than 1.5 wt %. In some embodiments, the alloys include Ni equal to or greater than 1.6 wt %. In some embodiments, the alloys include Ni equal to or greater than 1.7 wt %. In some embodiments, the alloys include Ni equal to or greater than 1.8 wt %. In some embodiments, the alloys include Ni equal to or greater than 1.9 wt %.

Molybdenum

The iron-based alloy can include a small amount of molybdenum (Mo). Mo is undesirable because it increases the necessary nitrogen gas pressure during nitriding for an equivalent alloy nitrogen content. However, Mo is a common impurity in stainless steel that may exist in the raw material used for melting.

In some embodiments, the alloys include Mo less than or equal to 0.50 wt %. In some embodiments, the alloys include Mo less than or equal to 0.45 wt %. In some embodiments, the alloys include Mo less than or equal to 0.40 wt %. In some embodiments, the alloys include Mo less than or equal to 0.35 wt %. In some embodiments, the alloys include Mo less than or equal to 0.30 wt %. In some embodiments, the alloys include Mo less than or equal to 0.25 wt %. In some embodiments, the alloys include Mo less than or equal to 0.20 wt %. In some embodiments, the alloys include Mo less than or equal to 0.15 wt %. In some embodiments, the alloys include Mo less than or equal to 0.10 wt %. In some embodiments, the alloys include Mo less than or equal to 0.05 wt %.

Manganese

In some embodiments, the iron-based alloys include manganese (Mn) from up to 0.7 wt %.

In some embodiments, the alloys include less than or equal to 0.7 wt % Mn. In some embodiments, the alloys include less than or equal to 0.6 wt % Mn. In some embodiments, the alloys include less than or equal to 0.5 wt % Mn. In some embodiments, the alloys include less than or equal to 0.4 wt % Mn. In some embodiments, the alloys include less than or equal to 0.3 wt % Mn. In some embodiments, the alloys include less than or equal to 0.2 wt % Mn. In some embodiments, the alloys include less than or equal to 0.1 wt % Mn.

Silicon

In some embodiments, the iron-based alloys include silicon (Si) up to 0.6 wt %. In some embodiments, the alloys include Si less than 0.60 wt %. In some embodiments, the alloys include Si less than 0.55 wt %. In some embodiments, the alloys include Si less than 0.50 wt %. In some embodiments, the alloys include Si less than 0.45 wt %. In some embodiments, the alloys include Si less than 0.40 wt %. In some embodiments, the alloys include Si less than 0.35 wt %. In some embodiments, the alloys include Si less than 0.30 wt %. In some embodiments, the alloys include Si less than 0.25 wt %. In some embodiments, the alloys include Si less than 0.20 wt %. In some embodiments, the alloys include Si less than 0.15 wt %. In some embodiments, the alloys include Si less than 0.10 wt %. In some embodiments, the alloys include Si less than 0.05 wt %.

Copper

The iron-based alloy can include copper (Cu).

In some embodiments, the alloys include Cu less than or equal to 0.50 wt %. In some embodiments, the alloys include Cu less than or equal to 0.45 wt %. In some embodiments, the alloys include Cu less than or equal to 0.40 wt %. In some embodiments, the alloys include Cu less than or equal to 0.35 wt %. In some embodiments, the alloys include Cu less than or equal to 0.30 wt %. In some embodiments, the alloys include Cu less than or equal to 0.25 wt %. In some embodiments, the alloys include Cu less than or equal to 0.20 wt %. In some embodiments, the alloys include Cu less than or equal to 0.15 wt %. In some embodiments, the alloys include Cu less than or equal to 0.10 wt %. In some embodiments, the alloys include Cu less than or equal to 0.05 wt %.

Nitrogen

In some variations, the iron-based alloys can include Nitrogen (N). In various aspects, nitrogen provides for austenite formation (FCC crystallization) during nitriding, and corresponding hardening and mechanical strength. In various additional aspects, nitrogen can increase resistance to localized corrosion, especially in combination with molybdenum.

In the base BCC alloy, in some variations, the alloys include nitrogen less than or equal to 0.10 wt %. In some embodiments, the alloys include less than or equal to 0.09 wt % nitrogen. In some embodiments, the alloys include less than or equal to 0.08 wt % nitrogen. In some embodiments, the alloys include less than or equal to 0.07 wt % nitrogen. In some embodiments, the alloys include less than or equal to 0.06 wt % nitrogen. In some embodiments, the alloys include less than or equal to 0.05 wt % nitrogen. In some embodiments, the alloys include less than or equal to 0.04 wt % nitrogen. In some embodiments, the alloys include less than or equal to 0.03 wt %. In some embodiments, the alloys include less than or equal to 0.02 wt % nitrogen. In some embodiments, the alloys include less than or equal to 0.01 wt % nitrogen.

After nitriding, the base BCC alloy transforms into a FCC phase. The FCC phase can have 0.8 to 1.5 wt % nitrogen. In some embodiments, the FCC phase of the iron-based alloys include includes N equal to or less than 1.5 wt %. In some embodiments, the FCC phase includes N equal to or less than 1.4 wt %. In some embodiments, the FCC phase includes N equal to or less than 1.3 wt %. In some embodiments, the FCC phase includes N equal to or less than 1.2 wt %. In some embodiments, the phase includes N equal to or less than 1.1 wt %. In some embodiments, the FCC phase includes N equal to or less than 1.0 wt %. In some embodiments, the FCC phase includes N equal to or less than 0.9 wt %.

In some embodiments, the FCC phase includes N equal to or greater than 0.8 wt %. In some embodiments, the FCC phase includes N equal to or greater than 0.9 wt %. In some embodiments, the FCC phase includes N equal to or greater than 1.0 wt %. In some embodiments, the FCC phase includes N equal to or greater than 1.1 wt %. In some embodiments, the FCC phase includes N equal to or greater than 1.2 wt %. In some embodiments, the FCC phase includes N equal to or greater than 1.3 wt %. In some embodiments, the FCC phase includes N equal to or greater than 1.4 wt %.

Other Alloying Elements

In some variations, the iron-based alloys can include Sulfur (S). In some variations, the iron-based alloys may include S in an amount less than or equal to 0.01 wt %. In some embodiments, the alloys include S in an amount less than or equal to 0.008 wt %. In some embodiments, the alloys include S in an amount less than or equal to 0.006 wt %. In some embodiments, the alloys include S in an amount less than or equal to 0.004 wt %. In some embodiments, the alloys include S in an amount less than or equal to 0.002 wt %.

In some variations, the iron-based alloys may include Phosphorus (P).

In some embodiments, the iron-based alloys may also include P less than or equal to 0.04 wt %. In some embodiments, the alloys include P less than or equal to 0.03 wt %. In some embodiments, the alloys include P less than or equal to 0.02 wt %. In some embodiments, the alloys include P less than or equal to 0.01 wt %.

In some variations, the iron-based alloys can include Calcium (Ca). In some embodiments, the alloys include less than or equal to 0.0050 wt % Ca. In some embodiments, the alloys include less than or equal to 0.0045 wt % Ca. In some embodiments, the alloys include less than or equal to 0.0040 wt % Ca. In some embodiments, the alloys include less than or equal to 0.0035 wt % Ca. In some embodiments, the alloys include less than or equal to 0.0030 wt % Ca. In some embodiments, the alloys include less than or equal to 0.0025 wt % Ca. In some embodiments, the alloys include less than or equal to 0.0020 wt %. In some embodiments, the alloys include less than or equal to 0.0015 wt % Ca. In some embodiments, the alloys include less than or equal to 0.0010 wt % Ca. In some embodiments, the alloys include less than or equal to 0.0005 wt % Ca.

In some variations, the iron-based alloys can include Vanadium (V). In some embodiments, the alloys include less than or equal to 0.15 wt % V. In some embodiments, the alloys include less than or equal to 0.13 wt % V. In some embodiments, the alloys include less than or equal to 0.11 wt % V. In some embodiments, the alloys include less than or equal to 0.09 wt % V. In some embodiments, the alloys include less than or equal to 0.07 wt % V. In some embodiments, the alloys include less than or equal to 0.05 wt % V. In some embodiments, the alloys include less than or equal to 0.03 wt % V. In some embodiments, the alloys include less than or equal to 0.01 wt % V.

V is undesirable, because V may reduce the available temperature-pressure processing window. In some embodiments, V may be no higher than 500 ppm.

In some variations, the iron-based alloys can include less than 0.1 wt % Titanium (Ti).

In some variations, the iron-based alloys can include less than 0.5 wt % Niobium (Nb). Ti and/or Nb should be controlled less than 100 ppm to avoid the formation of or limit the fraction of stable Ti and/or Nb nitrides that may form during nitriding. If Ti and/or Nb are too high, there may be polishing issues with the alloys.

In some variations, the iron-based alloys can include Aluminum (Al). In some variations, the alloys include less than or equal to 0.01 wt % Al. In some embodiments, the alloys include less than or equal to 0.008 wt % Al. In some embodiments, the alloys include less than or equal to 0.006 wt % Al. In some embodiments, the alloys include less than or equal to 0.004 wt % Al. In some embodiments, the alloys include less than or equal to 0.002 wt % Al.

In some variations, the iron-based alloys can include oxygen (O). In some variations, the alloys include less than or equal to 0.010 wt % oxygen. In some embodiments, the alloys include less than or equal to 0.009 wt % oxygen. In some embodiments, the alloys include less than or equal to 0.008 wt % oxygen. In some embodiments, the alloys include less than or equal to 0.007 wt % oxygen. In some embodiments, the alloys include less than or equal to 0.006 wt % oxygen. In some embodiments, the alloys include less than or equal to 0.005 wt % oxygen. In some embodiments, the alloys include less than or equal to 0.004 wt % oxygen. In some embodiments, the alloys include less than or equal to 0.003 wt %. In some embodiments, the alloys include less than or equal to 0.002 wt % oxygen. In some embodiments, the alloys include less than or equal to 0.001 wt % oxygen.

In some embodiments, the alloys include other trace elements in an amount less than or equal to 0.10 wt %. In some embodiments, the alloys include other trace elements in an amount less than or equal to 0.09 wt %. In some embodiments, the alloys include other trace elements in an amount less than or equal to 0.08 wt %. In some embodiments, the alloys include other trace elements in an amount less than or equal to 0.07 wt %. In some embodiments, the alloys include other trace elements in an amount less than or equal to 0.06 wt %. In some embodiments, the alloys include other trace elements in an amount less than or equal to 0.05 wt %. In some embodiments, the alloys include other trace elements in an amount less than or equal to 0.04 wt %. In some embodiments, the alloys include other trace elements in an amount less than or equal to 0.03 wt %. In some embodiments, the alloys include other trace elements in an amount less than or equal to 0.02 wt %. In some embodiments, the alloys include other trace elements in an amount less than or equal to 0.01 wt %. Trace elements can include incidental elements that can be present, for example, as a byproduct of processing and manufacturing.

In some variations, the alloy may include less than or equal to 0.04 wt % P. In further variations, the alloy may include less than or equal to 0.01 wt % S. In further variations, the alloy may include less than or equal to 0.010 wt % Al. In further variations, the alloy may include less than or equal to 0.15 wt % V. In further variations, the alloy may include less than or equal to 0.0050 wt % Ca. In further variations, the alloy may include less than or equal to 0.01 wt % O. In further variations, the alloy may include less than or equal to 0.1 wt % Ti. In further variations, the alloy may include less than or equal to 0.5 wt % Nb. In further variations, the alloy may include trace elements each in a quantity of less than or equal to 0.1 wt %. In some variation, the alloy has 0.8 wt %-1.5 wt % nitrogen in a FCC phase. In further variations, the alloy may include less than or equal to 0.1 wt % N in a BCC phase.

Recrystallization and Grain Size

Referring again to FIG. 2, the quenched alloy can be recrystallized at operation 222. The quenched alloy can be recrystallized at an elevated temperature for a period of time to form a recrystallized alloy. The recrystallization can provide control of grain size control, for example, finer grain size and more uniform grain sizes. When the quenched post-nitriding alloy is recrystallized at an elevated temperature, such as 1180° C. for 1 hour, new FCC grains grow and Cr nitride ($Cr_2N$) can be re-dissolved. The recrystallized alloy may then be quenched to room temperature to form a hardened machined alloy at operation 226.

The recrystallization temperature may be determined using the following steps, including (a) Nitride about the solvus temperature of the Cr Nitride phase (only FCC or possibly FCC+Ti or Nb nitride based on Ti or Nb impurity level); (b) Quench to an intermediate temperature where there is an eutectoid reaction (FCC→BCC+Cr Nitride). This forms a high number of BCC grains; and (c) Return to initial temperature of step (1) to dissolve the Cr-nitrides, while the high number of BCC grains convert to a high number (and therefore fine grain size) of FCC.

In various aspects, properties such as hardness and strength are inversely proportional to the grain size. In some embodiments, the average grain size is less than 100 μm. In some embodiments, the average grain size is less than 90 μm. In some embodiments, the average grain size is less than 80 μm. In some embodiments, the average grain size is less than 70 μm. In some embodiments, the average grain size is less than 60 μm. In some embodiments, the average grain size is less than 50 μm. In some embodiments, the average grain size is less than 40 μm. In some embodiments, the average grain size is less than 30 μm.

In some embodiments, the average grain size is greater than 20 μm. In some embodiments, the average grain size is greater than 30 μm. In some embodiments, the average grain size is greater than 40 μm. In some embodiments, the average grain size is greater than 50 μm. In some embodiments, the average grain size is greater than 60 μm. In some embodiments, the average grain size is greater than 70 μm. In some embodiments, the average grain size is greater than 80 μm. In some embodiments, the average grain size is greater than 90 μm.

In some embodiments, the average grain size deviation is less than 30 μm. In some embodiments, the average grain size deviation is less than 25 μm. In some embodiments, the average grain size deviation is less than 20 μm. In some embodiments, the average grain size deviation is less than 15 μm. In some embodiments, the average grain size deviation is less than 10 μm.

In some embodiments, the average grain size deviation is greater than 5 μm. In some embodiments, the average grain size deviation is greater than 10 μm. In some embodiments, the average grain size deviation is greater than 15 μm. In some embodiments, the average grain size deviation is greater than 20 μm. In some embodiments, the average grain size deviation is greater than 25 μm.

Transformation Depth and Non-Magnetic FCC

As described herein, the pre-nitriding alloy can be transformed to the post-nitriding alloy by solution nitriding. Table 1 summarizes the changes of crystal structure and magnetic property before and after the transformation of the iron-based alloy. The alloy undergoes a phase transition from a BCC crystalline structure to a FCC crystalline structure. The pre-nitrided alloy has a BCC structure, and is magnetic. The post-nitrided alloy has a FCC crystal structure, and is non-magnetic.

TABLE 1

| Pre-Nitriding Alloy | Post-Nitriding Alloy |
|---|---|
| BCC | FCC |
| α phase, ferrite | γ phase, austenite |
| Magnetic | Non-magnetic |

In some embodiments, the transformation depth is equal to or less than 4 mm from the alloy surface. In some embodiments, the transformation depth is equal to or less than 3.5 mm from the alloy surface. In some embodiments, the transformation depth is equal to or less than 3 mm from the alloy surface. In some embodiments, the transformation depth is equal to or less than 2.5 mm from the alloy surface. In some embodiments, the transformation depth is equal to or less than 2.0 mm from the alloy surface. In some embodiments, the transformation depth is equal to or less than 1.5 mm from the alloy surface. In some embodiments, the transformation depth is equal to or less than 1.4 mm from the alloy surface. In some embodiments, the transformation depth is equal to or less than 1.3 mm from the alloy surface. In some embodiments, the transformation depth is equal to or less than 1.2 mm from the alloy surface. In some embodiments, the transformation depth is equal to or less than 1.1 mm from the alloy surface. In some embodiments, the transformation depth is equal to or less than 1.0 mm from the alloy surface. In some embodiments, the transformation depth is equal to or less than 0.9 mm from the alloy surface. In some embodiments, the transformation depth is equal to or less than 0.8 mm from the alloy surface. In some embodiments, the transformation depth is equal to or less than 0.7 mm from the alloy surface. In some embodiments, the transformation depth is equal to or less than 0.6 mm from the alloy surface. In some embodiments, the transformation depth is equal to or less than 0.5 mm from the alloy surface. In some embodiments, the transformation depth is equal to or less than 0.4 mm from the alloy surface. In some embodiments, the transformation depth is equal to or less than 0.3 mm from the alloy surface. In some embodiments, the transformation depth is equal to or less than 0.2 mm from the alloy surface. In some embodiments, the transformation depth is equal to or less than 0.1 mm from the alloy surface.

Hardness

In variations of the disclosure, the hardness may vary with alloy composition and solution nitriding parameters. In some variations, the hardness is at least 300 Hv. In some variations, the hardness is at least 310 Hv. In some variations, the hardness is at least 320 Hv. In some variations, the hardness is at least 330 Hv. In some variations, the hardness is at least 340 Hv. In some variations, the hardness is at least 350 Hv. In some variations, the hardness is at least 360 Hv. In some variations, the hardness is at least 370 Hv. In some variations, the hardness is at least 380 Hv. In some variations, the hardness is at least 390 Hv. In some variations, the hardness is at least 400 Hv. In some variations, the hardness is at least 410 Hv.

In some variations, the standard deviation of hardness variation is no greater than 30 Hv. In some variations, the standard deviation of hardness variation is no greater than 25 Hv. In some variations, the standard deviation of hardness variation is no greater than 20 Hv. In some variations, the standard deviation of hardness variation is no greater than 15 Hv. In some variations, the standard deviation of hardness variation is no greater than 10 Hv. In some variations, the standard deviation of hardness variation is no greater than 5 Hv.

Corrosion Resistance

The corrosion resistance of the alloys can be measured as a lower passive current density or higher pitting potential. In some variations, the pitting potential of the polished alloy is at least 800 $mV_{SCE}$. In some variations, the pitting potential of the polished alloy is at least 900 $mV_{SCE}$. In some variations, the pitting potential of the polished alloy is at least 1000 $mV_{SCE}$. In some variations, the pitting potential of the polished alloy is at least 1100 $mV_{SCE}$.

In some variations, the pitting potential of the unpolished alloy is at least 600 $mV_{SCE}$. In some variations, the pitting potential of the unpolished alloy is at least 650 $mV_{SCE}$. In some variations, the pitting potential of the unpolished alloy is at least 700 $mV_{SCE}$. In some variations, the pitting potential of the unpolished alloy is at least 750 $mV_{SCE}$.

It will be appreciated by those skilled in the art that corrosion resistance may vary with composition, solution nitriding parameters, and polishing condition.

Dimensional Change

Maintaining consistent dimensions of the alloy during processing allows for consistent measurements during processing. In some aspects, a contraction (e.g., a linear contraction) of the alloy can result from a reduction packing density when the alloy crystals change from BCC to FCC crystals.

The reduction in packing density can be compensated for by adding nitrogen to the sample during the solution nitriding. Increase in nitriding can result in the expansion (e.g., linear expansion) of the alloy. Such changes can be measured by, for example, a linear dimension change before nitriding and after nitriding.

In some embodiments, the linear dimensional change is less than 0.3%. In some embodiments, the linear dimensional change is less than 0.2%. In some embodiments, the linear dimensional change is less than 0.1%. In some embodiments, the linear dimensional change is less than 0.05%. In some embodiments, the linear dimensional change is less than 0.04%. In some embodiments, the linear dimensional change is less than 0.03%. In some embodiments, the linear dimensional change is less than 0.02%. In some embodiments, the linear dimensional change is less than 0.01%. In some embodiments, the linear dimensional change is less than 0.005%.

The disclosed alloys and methods can be used in the fabrication of electronic devices. An electronic device herein can refer to any electronic device known in the art. For example, such devices can include wearable devices such as a watch (e.g., an AppleWatch®). Devices can also be a telephone such a mobile phone (e.g., an iPhone®) a land-line phone, or any communication device (e.g., an electronic email sending/receiving device). The alloys can be a part of a display, such as a digital display, a TV monitor, an electronic-book reader, a portable web-browser (e.g., iPad®), and a computer monitor. Alloys can also be an entertainment device, including a portable DVD player, conventional DVD player, Blue-Ray disk player, video game console, music player, such as a portable music player (e.g., iPod®), etc. Alloys can also be a part of a device that provides control, such as controlling the streaming of images, videos, sounds (e.g., Apple TV®), or alloys can be a remote control for an electronic device. Alloys can be a part of a computer or its accessories, such as the hard drive tower housing or casing, laptop housing, laptop keyboard, laptop track pad, desktop keyboard, mouse, and speaker.

EXAMPLES

The following non-limiting examples are included as illustrations of the disclosure.

Example 1

A simulation of alloy Fe-24Cr-1.5Ni was performed to predict that nitriding temperature may vary from 1120 to 1180° C.

After solution nitriding at 1180° C. with a nitrogen gas pressure of 0.95 bar for 12 hours, the alloy was surface hardened with a depth of about 0.75 mm. The surface diffusion process of nitrogen was limited to a sample having a cross-section with a thickness of 1.5 mm. Alloys thinner than the processing depth can be fully transformed into FCC to be non-magnetic. After solution nitriding, the alloy changes phase from BCC to FCC and become non-magnetic.

Table 2 illustrates the calculated thickest dimension and nitriding time for the iron-based alloys.

TABLE 2

| Thickest Dimension (mm) | Nitriding Time (hours) |
|---|---|
| 1.5 | 12 |
| 2 | 20 |
| 2.5 | 33 |
| 3 | 47 |

The average grain size of an alloy was measured before and after recrystallization. The post-nitriding alloy had an average grain size of 137 μm with a standard deviation of 44 μm without recrystallization treatment. With recrystallization, the post-nitriding alloy was measured to have an average grain size of 63 μm with a standard deviation of 17 μm.

Example 2

Figure 3:
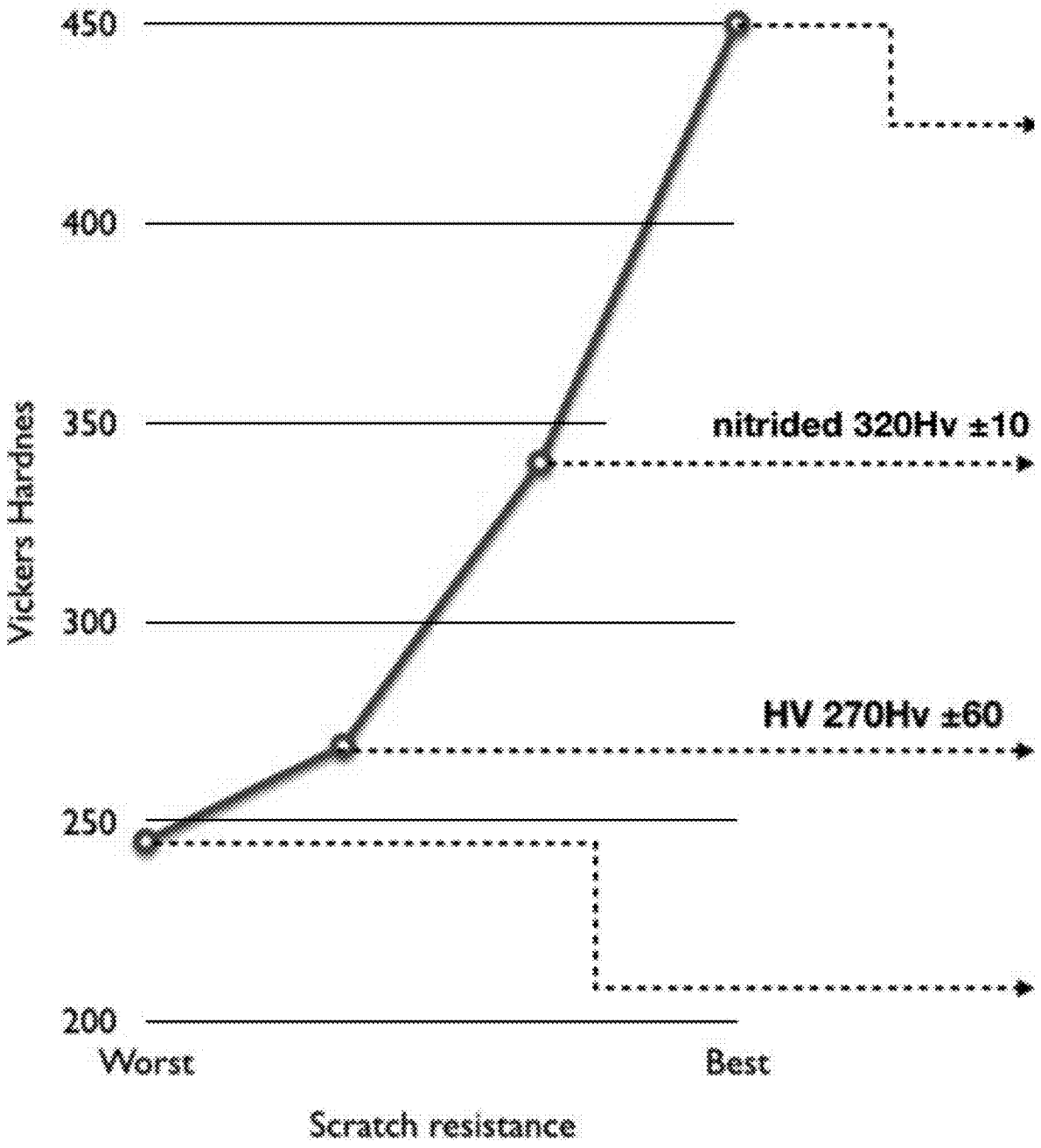
FIG. 3 illustrates scratch resistance is proportional to hardness in an embodiment of the disclosure.

The hardness of the Fe-24.0Cr-1.5Ni-0.5Si-0.5Mn alloy was measured per ASTM E384. FIG. 3 illustrates scratch resistance is proportional to hardness in various embodiments. As shown in FIG. 3, when the hardness is 250 Hv, the scratch resistance was poor.

The nitrided alloy has a hardness of 320 Hv having a standard deviation of 10 Hv, which has a better scratch resistance than the alloy with a hardness of 270 Hv having a standard deviation of 60 Hv. The alloy with high hardness can also be more resistant to dent or deformation.

Experiments revealed that the hardness was significantly increased over the conventional steel after solution nitriding. The hardness was also more uniform with much smaller variations than the conventional alloy.

Figure 4:
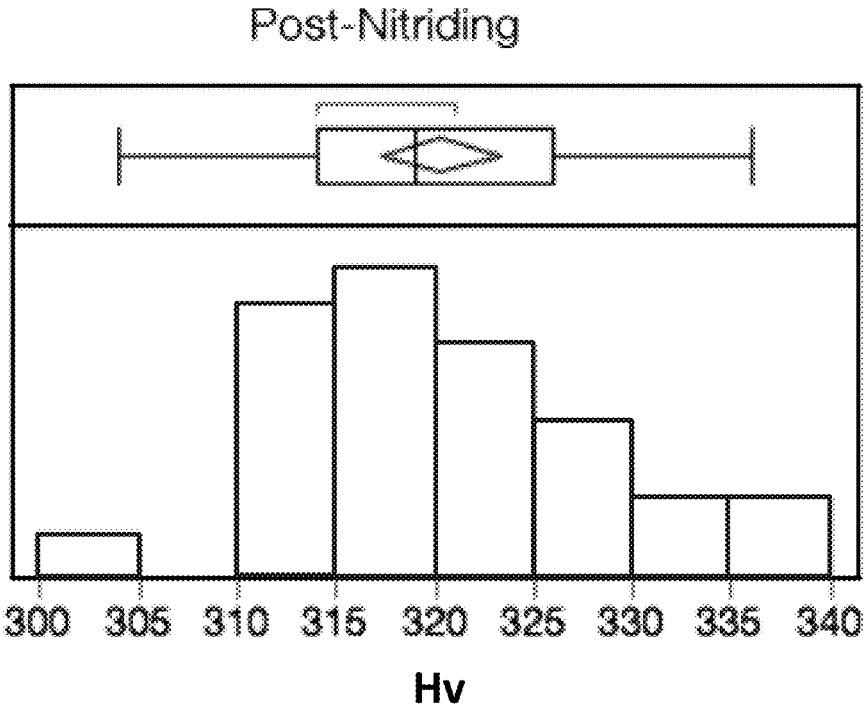
FIG. 4 illustrates hardness distribution after solution nitriding in an embodiment of the disclosure.

FIG. 4 illustrates hardness distribution of the Fe-24.0Cr-1.5Ni-0.5Si-0.5Mn alloy after solution nitriding in an embodiment of the disclosure. As shown, the average hardness is 320 Hv with a standard deviation of 8 Hv.

Example 3

Grain size can be measured for comparison of the alloys before and after recrystallization.

Experiments showed that after recrystallization, the grain size became smaller and more uniform than without recrystallization. For alloy Fe-24.0Cr-1.5Ni-0.5Si-0.5Mn, the average grain size was 137 μm with a standard deviation of 44 μm without recrystallization. With recrystallization, the average grain size was 63 μm with a standard deviation of 17 μm.

Example 4

Corrosion resistance of the alloy was evaluated by a salt spray test in accordance to ASTM B117.

Figure 5:
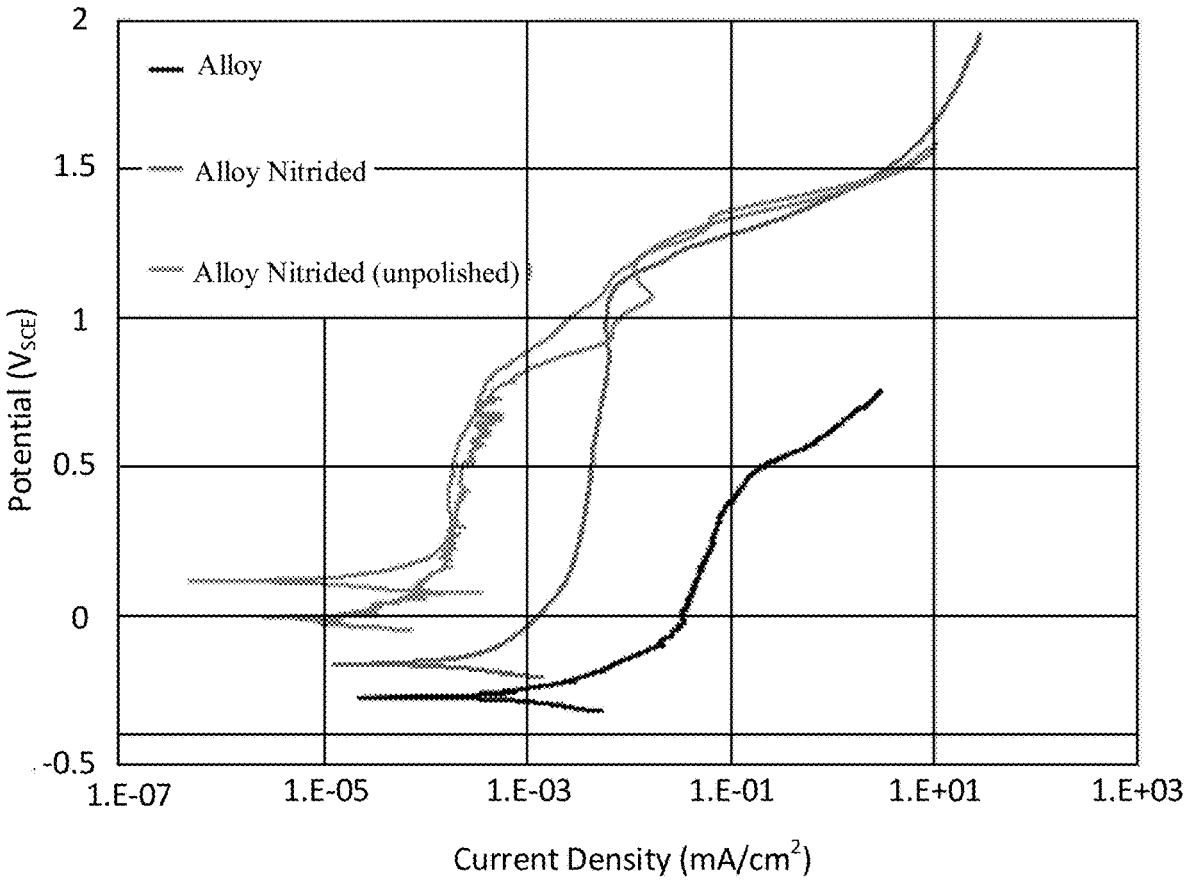
FIG. 5 illustrates potential versus current density for alloys without and without solution nitriding in an embodiment of the disclosure.

FIG. 5 illustrates potential versus current density for Fe-24.0Cr-1.5Ni-0.5Si-0.5Mn alloys without and without solution nitriding in an embodiment of the disclosure. Table 3 shows the corrosion comparison of post-nitriding alloy or nitrided alloy (polished and unpolished) vs. pre-nitriding alloy or non-nitrided alloy.

TABLE 3

| Alloy | Pitting Potential ($mV_{SCE}$) | Passive Current Density ($mA/cm^2$) |
|---|---|---|
| Non-nitrided | 470 | $5.6 \times 10^{-2}$ |
| Nitrided (polished) | 1,130 | $4.6 \times 10^{-3}$ |
| Nitrided (unpolished) | 782 | $2 \times 10^{-4}$ |

As shown in FIG. 5, an unpolished post-nitriding alloy showed an increase in pitting potential compared to a pre-nitriding alloy. The pitting potential of the non-nitrided alloy had a pitting potential of 470 $mV_{SCE}$, while the unpolished nitrided alloy had a pitting potential of 782 $mV_{SCE}$, The polished nitride alloy had a pitting potential of 1,130 $mV_{SCE}$. The pitting potential of the unpolished post-nitriding alloy was lower than the polished post-nitriding alloy. This was consistent with the observation of surface roughness, a property that affects the pitting potential.

The nitrided alloy had a passive current density of $2\times10^{-4}$, while the polished nitride alloy had a passive current density of $4.6\times10^{-3}$. The unpolished post-nitriding alloy had a lower passive current density than the polished post-nitriding alloy. The experiments revealed that both polished and unpolished nitride alloys had better corrosion resistance than the non-nitrided alloy.

Example 5

The hardness may be further improved by a second step nitriding process following a first step nitriding process. In one embodiment, the second step nitriding process may be performed in a lower gas pressure than the first nitriding step. For example, the first nitriding process may be performed at a $N_2$ gas pressure of 2.3 bar. The second nitriding process may be performed at a $N_2$ gas pressure of 1.8 bar. The temperature for the second nitriding process may be the same as for the first nitriding process.

The two-step nitriding process improves the amount of N in the alloy, which minimizes the nitride formation and increases the hardness. As an example, the N can be increased to 1.4 wt % with the two-step nitriding process. The amount of N in the alloy can be measured by instrumental gas analysis (IGA) or spark optical emission spectroscopy, among other techniques.

The hardness improvement by nitriding may vary with the alloy composition. For example, nitriding experiments were performed for the present alloy. The hardness was measured for the present Fe-based alloys.

Figure 6:
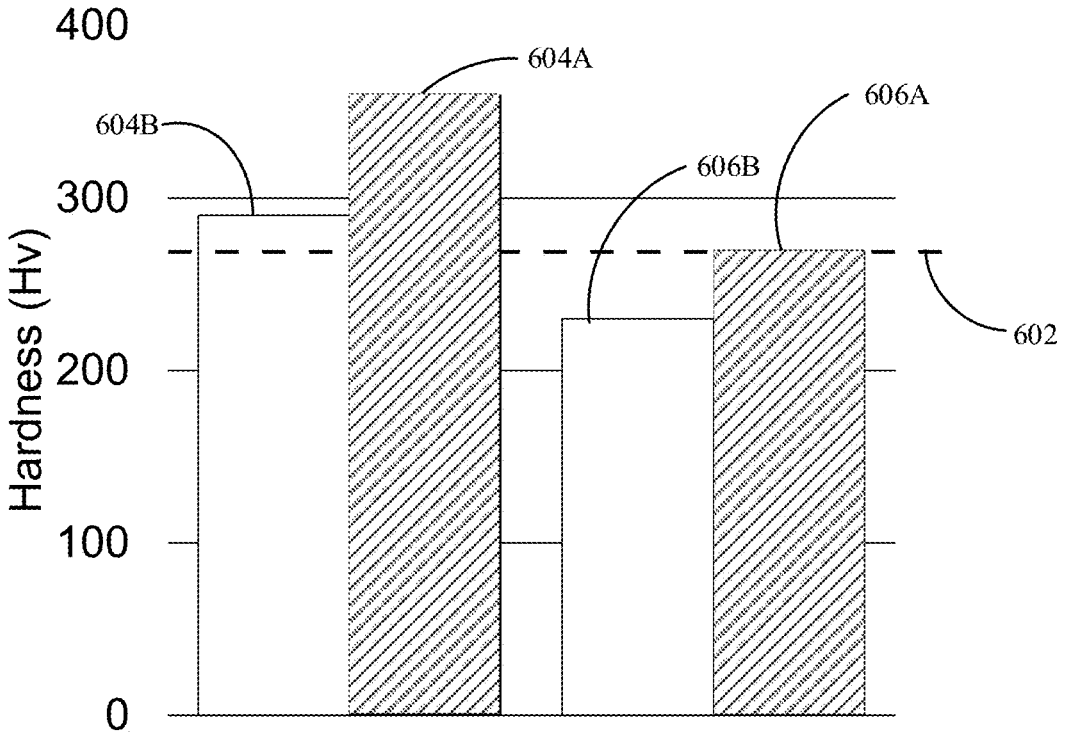
FIG. 6 illustrates the hardness data that demonstrates significant improvement after nitriding the present Fe-based alloys in accordance with embodiments of the disclosure.

FIG. 6 shows the hardness data that demonstrates significant improvement after nitriding the present Fe-based alloys in accordance with embodiments of the disclosure. As shown in FIG. 6, the present Fe-based alloy has a hardness of about 360 Hv shown by bar 604A, which is higher than about 280 Hv for a baseline or reference alloy (e.g. alloy 316 forging) shown by baseline 602. The expected hardness by ThermoCalc modeling shown by bar 604B is about 295 Hv, which is above the baseline value shown by dash line 602.

In contrast, nitriding 316 does not improve hardness. As shown in FIG. 6, the hardness of 316 after nitriding is about 280 Hv shown by bar 606A, which remains about the same as the baseline (e.g. alloy 316 forging) shown by bar 602. The expected hardness by ThermoCalc modeling shown by bar 606B is about 230 Hv, which is below the baseline value shown by dash line 602. As such, nitriding surprisingly improves the hardness for the present Fe-based alloy over forging. The present Fe-based alloys include chromium (Cr) ranging from 21 wt % to 25.5 wt %, low nickel (Ni) content ranging from 0.5 wt % to 2.0 wt %, and less than or equal to 0.5 wt % molybdenum (Mo). The Ni and Mo contents are much lower than commercial stainless steel alloys, such as stainless steel 316.

The high hardness seems to be associated with the observed high N value in the present Fe-based alloy. The N in the present Fe-based alloy was determined to be 1.4 wt % after the two-step nitriding process described above. However, the N in the present Fe-based alloy was determined to be 1.0 wt % after a single step nitriding process, which is less than the N of 1.4 wt % after the two-step nitriding process. The ThermoCalc modeling also determines the N in the present Fe-based alloy to be 1.0 wt %. Surprisingly, the two-step nitriding process results in higher N content in the present Fe-based alloy than the single step nitriding process or the estimated value from the ThermoCalc modeling.

Figure 7:
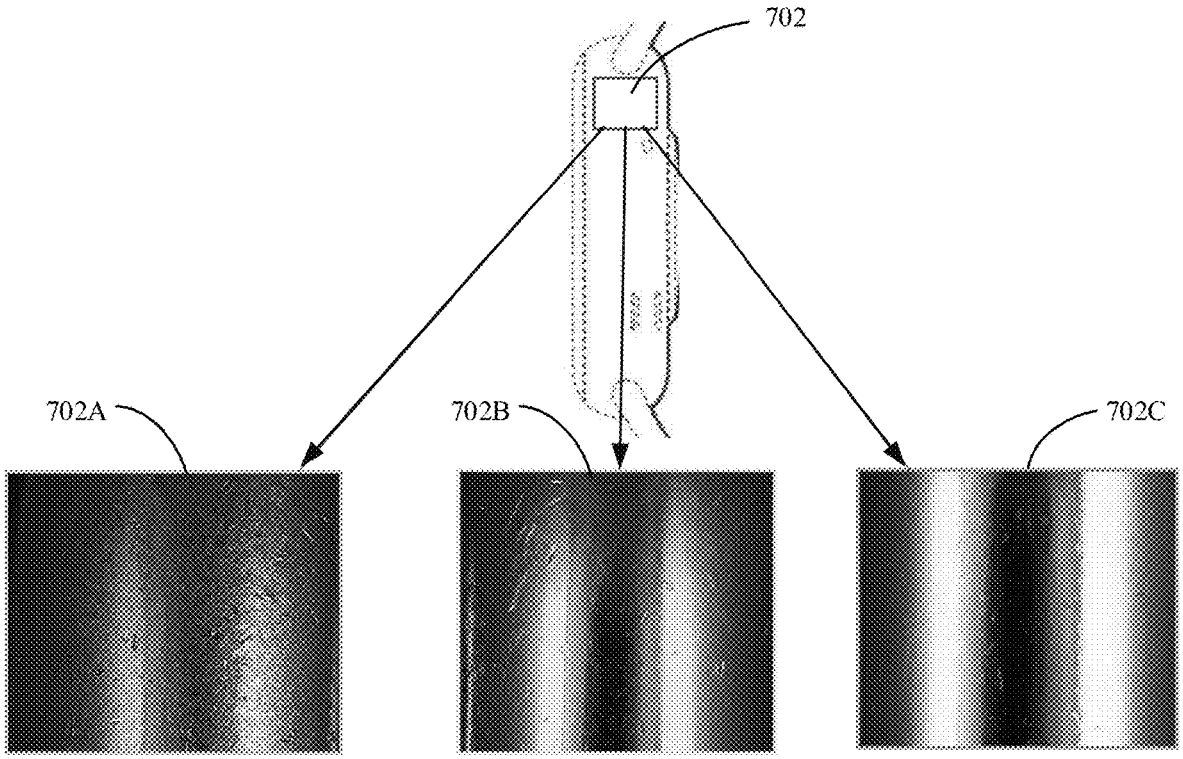
FIG. 7 illustrates optical photographs of the scratched surfaces in accordance with embodiments of the disclosure.

FIG. 7 shows optical photographs of the scratched surfaces in accordance with embodiments of the disclosure. As shown in FIG. 7, a component has an area 702 that can be formed of an alloy, i.e. stainless steel 316 forging (referred to "316 foging"), stainless steel 316 nitriding (referred to "316 nitriding"), and the present Fe-based alloy. References 702A, 702B, and 702C show enlarged optical photographs of the 316 forging, 316 nitriding, and the present Fe-based alloy, respectively. The alloy 316 after forging labeled by 702A reveals the most scratches. The alloy 316 after nitriding labeled by 702B shows improved scratch resistance. The present Fe-based alloy labeled by 702C reveals the best scratch resistance.

Figure 8A:
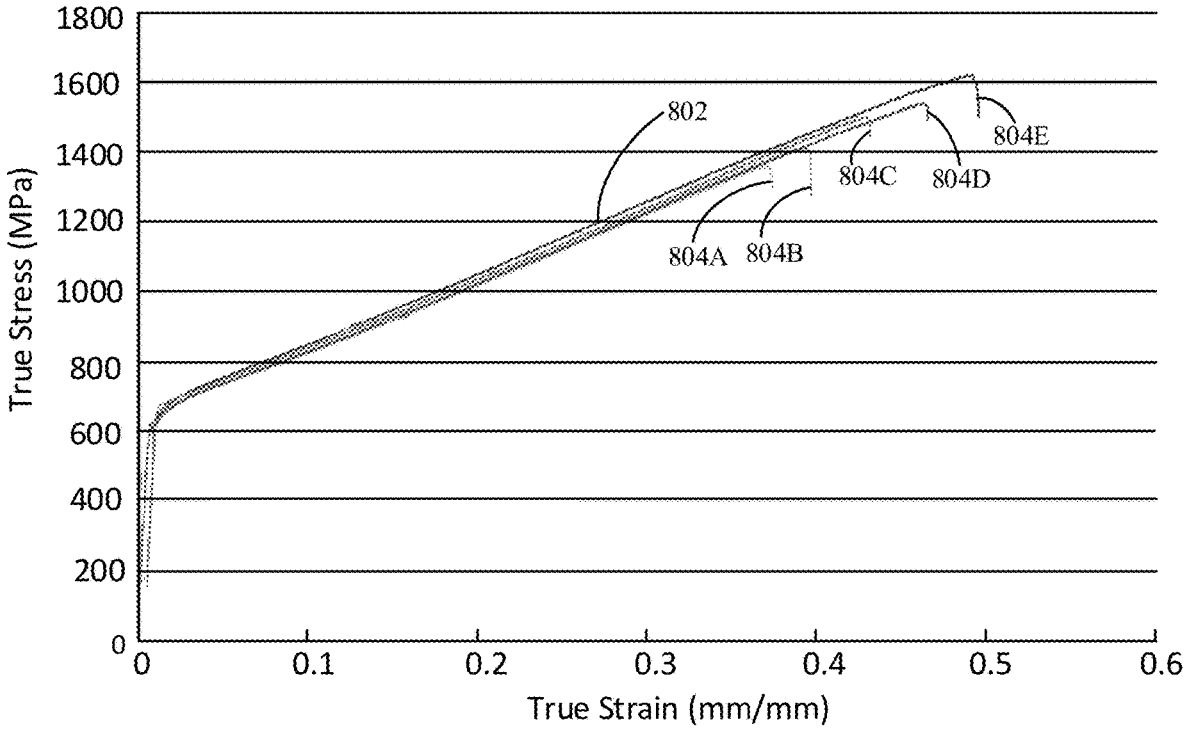
FIG. 8A illustrates the stress versus true strain curve for the present Fe-based alloy in accordance with embodiments of the disclosure.

FIG. 8A shows the true stress versus true strain curve for the present Fe-based alloy in accordance with embodiments of the disclosure. As shown in FIG. 8A, curve 802 shows the true stress increases with the true strain for several samples. The true stress is the applied load divided by the actual cross-sectional area (the changing area with respect to time) of the specimen at that load in a tensile test. The true strain equals the natural log of the quotient of current length L over the original length $L_0$ as given by following equation:

$$\varepsilon_t = \ln\frac{L}{L_0}$$

Samples A-E have slightly different ductility varying from about 0.4 to about 0.5 or 40% to about 50%.

The present Fe-based alloy has a yield strength of about 640 MPa, which is significantly higher than the baseline alloy (e.g. 316). Also, the present Fe-based alloy has a ductility of about 0.4 to 0.5, which is also significantly higher than the baseline alloy.

Figure 8B:
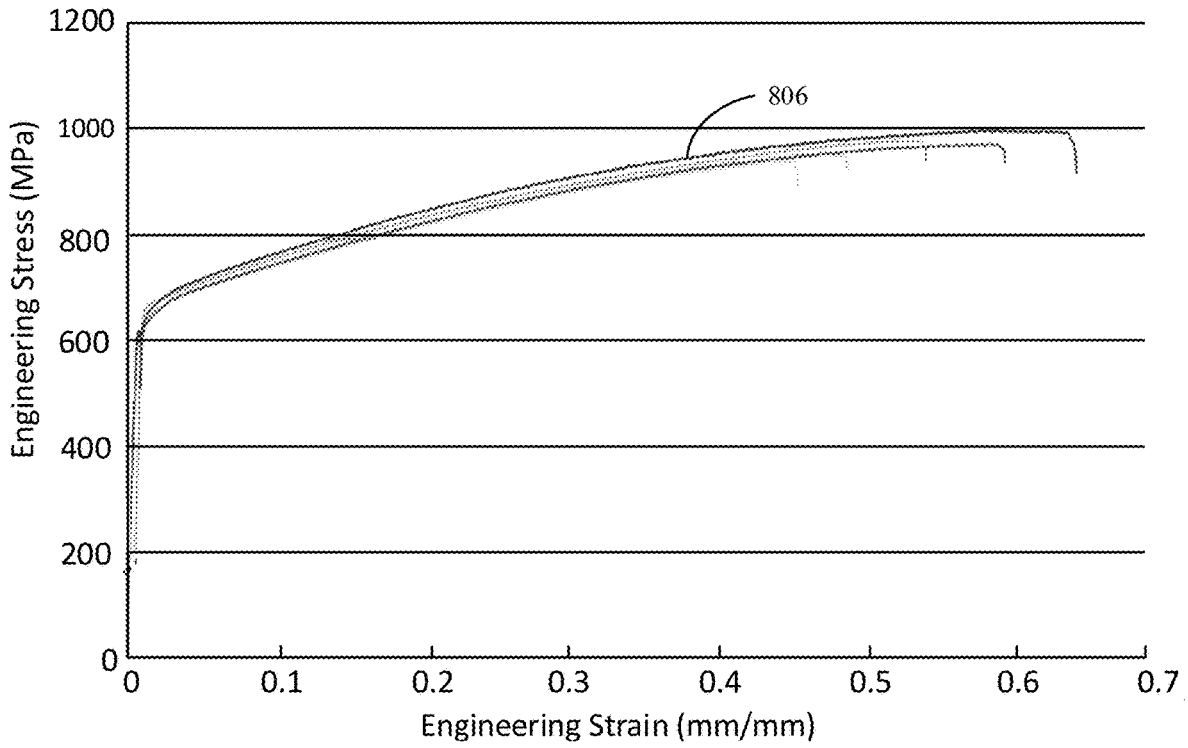
FIG. 8B illustrates the engineering stress versus engineering strain curve for the present Fe-based alloy in accordance with embodiments of the disclosure.

FIG. 8B shows the engineering stress versus engineering strain curve for the present Fe-based alloy in accordance with embodiments of the disclosure. As shown in FIG. 8B, curve 806 shows the stress increases with the strain for several samples. The engineering strain is expressed as the change in length ΔL per unit of the original length L of the sample in a tensile test. The engineering stress is the applied load divided by the original cross-sectional area of a material.

It will be appreciated by those skilled in the art that other Fe-based alloys including 304SS among others may also be hardened by nitriding. Conditions for the two-step nitriding processes may vary with the alloys.

Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the invention. Accordingly, the above description should not be taken as limiting the scope of the invention. Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the method and system, which, as a matter of language, might be said to fall therebetween.

What is claimed is:

1. An Fe-based alloy comprising:

21 to 25.5 wt % Cr;

0.8 to 2.0 wt % Ni;

0.8 wt % 1.5 wt % N;

up to 0.7 wt % Mn; and 0 to 0.5 wt % Mo;

wherein the balance is Fe and trace elements, wherein the alloy is in a FCC phase, and wherein the alloy has a recrystallized grain size between 20 μm and 100 μm.

2. The alloy of claim 1, comprising up to 0.6 wt % Si.

3. The alloy of claim 1, comprising less than or equal to 0.5 wt % Cu.

4. The alloy of claim 1, wherein the alloy further comprises:

less than or equal to 0.04 wt % P;

less than or equal to 0.01 wt % S;

less than or equal to 0.010 wt % Al;

less than or equal to 0.15 wt % V;

less than or equal to 0.0050 wt % Ca;

less than or equal to 0.01 wt % O;

less than or equal to 0.1 wt % Ti;

less than or equal to 0.5 wt % Nb; and trace elements each in a quantity of less than or equal to 0.1 wt %.

5. The alloy of claim 1, wherein the alloy has a hardness of at least 300 Hv.

6. The alloy of claim 1, wherein the alloy has a standard deviation in hardness of less than or equal to 10 Hv.

7. The alloy of claim 1, wherein the alloy has a pitting potential of at least 1000 mVsce.

8. The alloy of claim 1, wherein the alloy has a passive current density less than or equal to $2.0\times10^{-4}$ mA/cm$^2$ after being polished.

9. The alloy of claim 1, wherein the grain size has a standard deviation between 5 μm and 30 μm.

10. An alloy comprising:

21 to 25.5 wt % Cr;

0.8 to 2.0 wt % Ni;

0.8 wt %-1.5 wt % N;

up to 0.7 wt % Mn;

O to 0.5 wt % Mo, less than or equal to 0.04 wt % P;

less than or equal to 0.01 wt % S;

less than or equal to 0.010 wt % Al;

less than or equal to 0.15 wt % V;

less than or equal to 0.0050 wt % Ca;

less than or equal to 0.01 wt % O;

less than or equal to 0.1 wt % Ti;

less than or equal to 0.5 wt % Nb; and trace elements less than or equal to 0.1 wt %;

wherein the balance is Fe, wherein the alloy is in a FCC phase.

11. A method of making an iron-based alloy, the method comprising:

annealing an iron-based alloy comprising 21 to 25.5 wt % Cr, 0.8 to 2.0 wt % Ni; up to 0.7 wt % Mn; and less than or equal to 0.5 wt % Mo to form an annealed alloy comprising less than or equal to 0.1 wt% N in a BCC phase;

machining the annealed alloy to form a machined alloy; and hardening the machined alloy in a furnace filled with a nitrogen gas with a first gas pressure at a first elevated temperature for a first period of time to form a first hardened machined alloy, wherein the first hardened alloy comprises 0.8 wt %-1.5 wt % N in a FCC phase.

12. The method of claim 11, further comprising:

hardening the first hardened machined alloy in a furnace filled with a nitrogen gas with a second gas pressure at the first elevated temperature to form a second hardened machined alloy, wherein the second gas pressure is lower than the first gas pressure.

13. The method of claim 12, further comprising:

quenching the second hardened machined alloy to an eutectoid temperature for a second period of time to form a quenched alloy;

recrystallizing the quenched alloy at a second elevated temperature for a third period of time to form a recrystallized alloy; and quenching the recrystallized alloy to an ambient temperature to form a hardened alloy.

14. The method of claim 13, wherein the second hardened machined alloy has a FCC structure and is non-magnetic.

* * * * *